United States Patent [19]

Frazar

[11] 3,940,861

[45] Mar. 2, 1976

[54] CONDENSER APPARATUS

[75] Inventor: Joseph H. Frazar, Louisville, Ky.

[73] Assignee: General Electric Company, Louisville, Ky.

[22] Filed: Jan. 9, 1975

[21] Appl. No.: 539,577

[52] U.S. Cl. ..... 34/75; 261/90; 137/428; 417/40; 55/216; 55/230

[51] Int. Cl. ..... F26b 21/06

[58] Field of Search ..... 34/75, 45; 55/230, 227, 55/216; 261/26, 90; 137/428; 417/40

[56] References Cited

UNITED STATES PATENTS

| | | | |
|---|---|---|---|
| 2,589,089 | 3/1952 | Johnson | 417/40 |
| 2,646,067 | 7/1953 | Smith | 137/428 |
| 2,695,460 | 11/1954 | Clark | 34/75 |
| 3,022,581 | 2/1962 | Smith | 34/75 |
| 3,121,000 | 2/1964 | Hubbard | 34/75 |

*Primary Examiner*—Tim R. Miles
*Assistant Examiner*—Gregory N. Clements

[57] ABSTRACT

Condenser apparatus for removing moisture from the air including a housing for the condenser apparatus, which housing has both a cooling liquid inlet and an air inlet at one end. Within the housing is a condensing chamber and a rotatable disc spaced inwardly from the liquid inlet so that when the disc is rotated and liquid is impinged upon the disc a cooling liquid droplet cloud is produced in the condensing chamber. At the opposite end of the condenser housing from the inlet is an air outlet and a concentrically positioned rotatable blower. Located between the blower and the rotatable disc is a rotatable liquid droplet interceptor wheel for collecting entrained liquid droplets before they pass into the blower and depositing them into an underlying bath. Circumferentially around the interceptor wheel is a liquid pump that removes liquid from the condenser apparatus. An electric motor is utilized for rotatably driving all of the rotating elements. The condenser apparatus is provided with apparatus de-energization means including a liquid level sensing means connected in cooperative relationship to a switch for de-energizing the apparatus in the event of overflow and a means to retain the overflow liquid after de-energization.

6 Claims, 3 Drawing Figures

CONDENSER APPARATUS

BACKGROUND OF THE INVENTION

1. Field of the Invention

This invention relates to condenser apparatus, and more particularly to condenser apparatus for utilization in an automatic clothes dryer so that warm moisture-laden air from the clothes dryer is cooled and moisture removed therefrom.

2. Description of the Prior Art

In automatic clothes dryers it is common to vent the warm moisture-laden exhaust air or vapor outside the machine and preferably even outside the house or building while air is constantly being introduced into the clothes dryer, heated and passed over the fabrics to be dried. It is not, however, always possible and, in fact, it may not be desirable to provide such a venting system for automatic clothes dryers in apartments or other high rise housing establishments. In drying fabrics in a clothes dryer it is highly desirable to be able to heat the air, pass the heated air over the fabrics to be dried and withdraw moisture therefrom, remove the hot moisture-laden air from the fabrics and introduce it into an apparatus that lowers the temperature of the moisture-laden air thereby condensing out moisture from the air, then recirculate the air through the clothes dryer.

Condensing apparatus has been utilized in laundry machines, both combination clothes washers and dryers and automatic clothes dryers, for many years. One such condensing apparatus is shown in U.S. Pat. No. 2,451,692 wherein moist air is passed through a water spray from a nozzle that is also used to effect movement of the air and free water from a spray is removed by a stationary screen. Another type of condensing apparatus is disclosed in U.S. Pat. No. 2,785,557 wherein only a controlled portion of the moist air is passed through a dehumidifier. U.S. Pat. No. 2,921,384 shows apparatus that uses an impeller to circulate air that also has the cooling water discharged directly against the impeller, however, there is no free water collection means provided. U.S. Pat. No. 3,121,000 utilizes a condensing arrangement that produces a coherent film of water on a channel wall to avoid entrainment of water droplets.

A liquid droplet cloud in a condensing chamber through which the hot moisture-laden air from the dryer is passed is quite efficient for lowering the air temperature. However, such a system inherently produces entrainment of the free liquid droplets. It is desirable to collect these droplets and deposit them in an underlying bath before they can leave the condensing chamber. This is particularly desirable when the blower that induces the air flow through the condenser apparatus is in axial alignment with the condensing chamber and downstream from the liquid droplet cloud. Too much entrainment of free liquid can detrimentally affect the operation of the entire condenser apparatus and reduce the normal life of such an apparatus. Also, since the condenser apparatus may be utilized in an automatic clothes dryer it is desirable to minimize expelling free liquid from the condenser apparatus into the clothes dryer system.

With liquid being introduced into the condenser apparatus to form the liquid droplet cloud and the droplets being collected in the condensing chamber before they pass into the blower area it is necessary to have a pump to remove the liquid from the condensing chamber. In the event of a pump malfunction, such as clogging, it is highly desirable to have the incoming liquid stopped and the appliance turned off or de-energized. There is, however, a time lag in such an operation and overflow liquid needs to be contained where it will not come into contact with electrical components of the appliance. This improvement invention relates to a means for accomplishing this.

SUMMARY OF THE INVENTION

There is provided a condenser apparatus for removing moisture from the air, particularly a condenser apparatus that is utilized in connection with an automatic clothes dryer, which includes a housing for the condenser apparatus and has both a water or other cooling liquid inlet and an air inlet at one end, an air outlet at the opposite end of the housing, and a condensing chamber therebetween. Means for forming a cloud of liquid droplets in the condensing chamber is also included. Positioned near the air outlet of the condenser apparatus is a means, such as a blower, for inducing an air flow through the condenser apparatus from the air inlet to the air outlet passing through the liquid droplet cloud.

Means for collecting the liquid droplets before they pass into the blower is provided and arranged to deposit the collected liquid into an underlying bath at the bottom of the condensing chamber. The droplet collecting means is located between the means for forming the droplets and the air flow inducing means. Means for driving all of the rotating components is also provided.

There is a pump for removing liquid from the condenser chamber. An auxiliary liquid discharge outlet having an opening outside the condensing chamber is also provided.

This invention is an improvement on the condenser apparatus described and includes condenser apparatus deenergization means having a tray with side walls and two compartments. The first compartment underlies the auxiliary discharge outlet and has a liquid level sensing means connected to a switch for de-energizing the apparatus. The other compartment is separated from the first compartment by a partition having a height sufficient to retain liquid until the liquid level sensing means de-energizes the apparatus but is lower than the side walls of the tray.

DESCRIPTION OF THE PREFERRED EMBODIMENT

Figure 1:
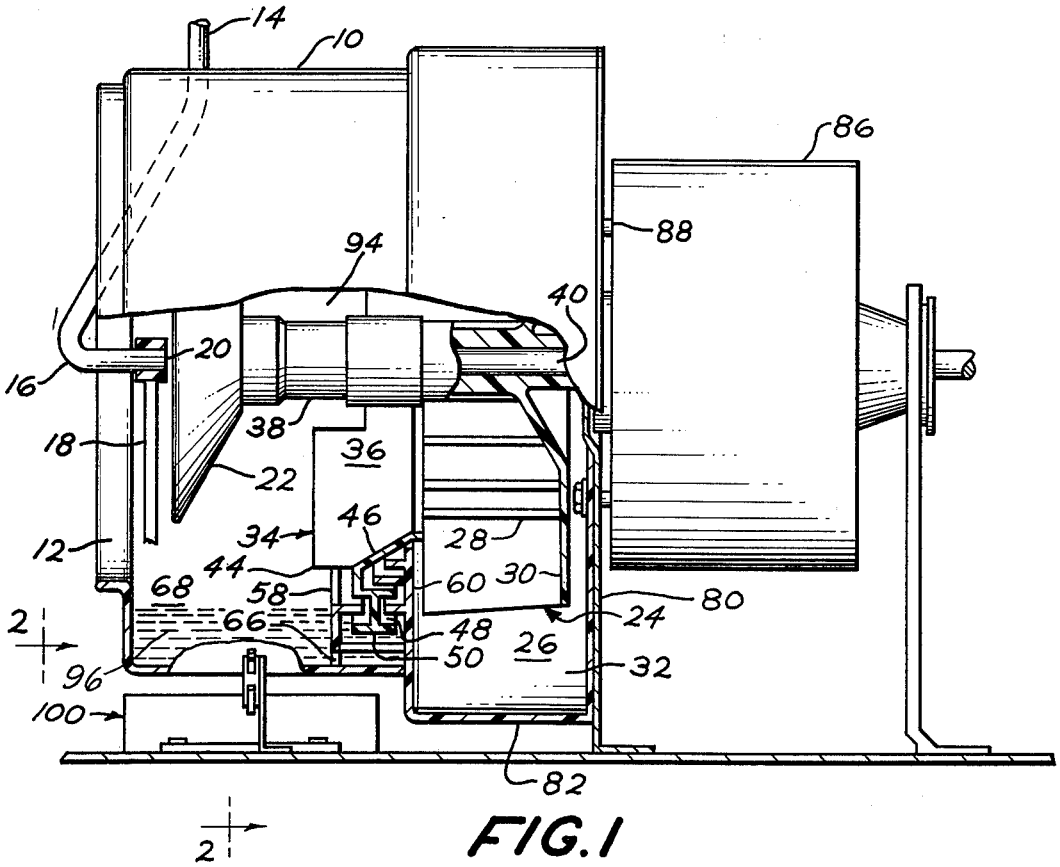
FIG. 1 is a side elevational, cross-sectional view of a condenser apparatus utilizing my improved deenergization means structural arrangement.
Figure 2:
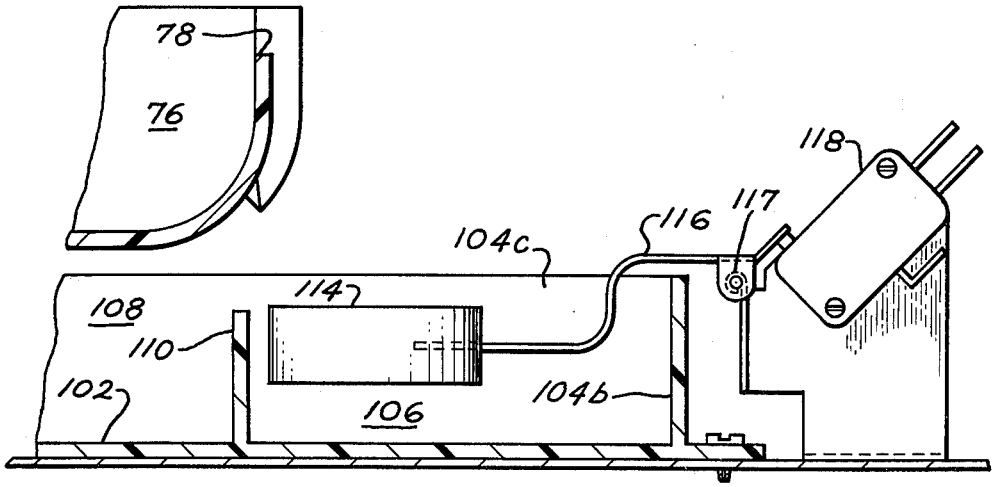
FIG. 2 is an enlarged side elevational view of a portion of the de-energization arrangement shown in cross section.
Figure 3:
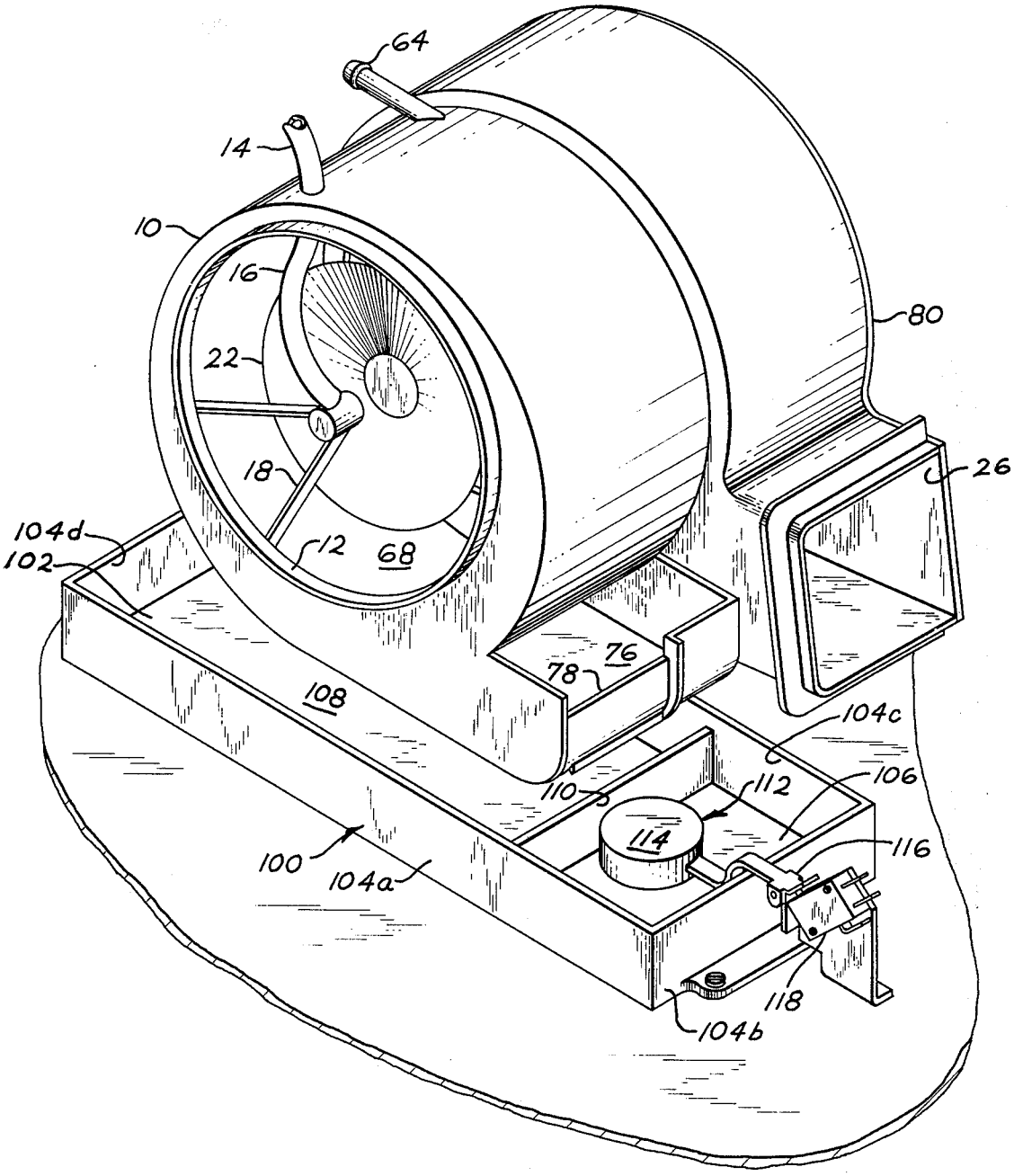
FIG. 3 is a perspective view of a condenser apparatus showing my improved de-energization means structural arrangement in position relative to the condenser apparatus.

With reference to the drawings, the condenser apparatus includes a housing 10 which is cylindrical or drum shaped and has an air inlet 12 located at the front of the condenser unit. Also located at the same end of the condenser housing 10 is a liquid inlet means 14 which may conveniently be a hose or tubular conduit 16 supported by structure 18 secured in a suitable fashion to the condenser housing. The structure 18 secures and positions the tubular conduit 16 substantially on the longitudinal axis of the condenser housing 10 with the end 20 of the conduit 16 directed into the condenser apparatus. The liquid introduced into the condenser apparatus by means of the tubular conduit 16 passes through a solenoid operated control valve (not shown) and is in the form of a stream. Spaced axially from the end 20 is a single rotatable disc 22.

At the opposite end of the condenser housing 10 from the liquid inlet means end 20 is a blower 24 for inducing air to flow from the air inlet 12 to an air outlet 26. The blower in this embodiment consists of a rotatable blower wheel having a plurality of blades 28 secured as by molding to circular plate 30 and a confining air space 32 surrounding the blower wheel for developing sufficient air pressure within the blower to induce the above-mentioned air flow. Positioned within the condenser housing 10 and located between the rotatable disc 22 and the blower 24 is a liquid droplet collecting means 34.

The liquid droplet collecting means 34 is in the form of a rotatable liquid droplet interceptor wheel having a plurality of equally spaced blades 36. The interceptor wheel 34 has a hub 38, the center of which is the axis about which the interceptor wheel rotates. The rear portion of the hub 38 is a hollow cylinder to be received upon the rotatable motor shaft 40 and secured thereto for rotation along with rotation of the motor shaft. The forward portion of the hub is also a hollow cylinder and it is adapted to receive the rotatable disc 22 for simultaneous rotation also along with the motor shaft. The blades 36 are thin and extend radially outward from the outer surface of the hub 38. The blades are arranged to minimize obstructing the air stream flowing through the interceptor wheel. To support the outer blade edges 44 they are secured to a circumferential ring member 46. The hub 38, blades 36, and outer support ring member 46 may all be integrally formed as by molding with each other from suitable plastic material. In this fashion the entire interceptor wheel is a one-piece molded component structure.

The pump 48 surrounds the liquid droplet interceptor wheel 34. Pump 48 partly consists of a rotatable inner wall 50 and a stationary outer pump wall which is the interior of housing 10. Forming the front part of the pump 48 is a circular wall member 58 that is rigidly secured to the inside of the condenser housing and depends inwardly therefrom. A back wall 60 of the pump is also provided. The inner, outer, front and back walls cooperate with each other to provide a pump cavity therebetween. At the top of the pump 48 is an outlet 64 which is in communication with the pump cavity through the outer pump wall so that liquid may be removed from and discharged outside the condenser apparatus. Through the circular wall member 58 is an opening 66 communicating with the underlying liquid bath at the bottom of the condensing chamber 68. The purpose of this opening is to allow liquid that accumulates in the bottom of the condensing chamber 68 to pass through the pump wall member 58 and into the pump cavity. The inlet to the pump operates on the venturi principle so that the pump 48 is self-priming.

It will be noted particularly that the pump 48 is circular and is circumferentially located around the interceptor wheel 34 which has a large air opening through the center thereof. As pointed out previously, this is quite advantageous in that it is desirable to have the air flowing through the condenser apparatus encounter only minimum resistance thus reducing the power requirements yet achieve proper air flow. The rotating inner pump wall 50 is carried by, and is integrally molded with, the circumferential ring member 46 of the liquid droplet collecting means 34. Therefore, as the interceptor wheel 34 is rotated the inner pump wall 50 is rotated simultaneously and at the same speed.

Located at the bottom of the condenser housing 10 is an auxiliary liquid discharge outlet having a sump 76 partially within the housing 10 and an outlet opening 78 outside the housing. Plumbing codes generally require a sufficient air gap in association with the water inlet, so that if a negative pressure is produced in the water line, only air will be taken in. It can be seen in the drawings that if the condenser pump 48 fails to operate, liquid accumulates in the condenser apparatus sump until it overflows, thus providing an air gap in the system between the discharge outlet 78 and liquid inlet end 20.

It is desirable that in the event of liquid overflowing from the condenser apparatus that the apparatus be de-energized and the flow of incoming liquid be stopped as quickly as possible to prevent possible electrical shock hazard and prevent damage to the electrical components of the condenser apparatus and any other components of the appliance such as an automatic clothes dryer, in which the condenser apparatus is used. By my improvement invention there is provided apparatus de-energization means that not only will afford fast de-energization and stop incoming liquid flow of the condenser apparatus but will accommodate any liquid being discharged from the auxiliary outlet during the time lag between the overflow condition and shutdown of the condenser apparatus. The apparatus for shutdown includes a tray 100 having a bottom wall 102 and side walls 104*a*, 104*b*, 104*c*, and 104*d*. All of the side walls may conveniently be of the same height from the bottom wall. The tray is divided into at least two compartments, one of which is a float containing compartment 106 and the other compartment 108 being a liquid reserve compartment to accommodate overflow liquid from the float containing compartment 106. Dividing the two compartments is a partition 110 which is slightly less in height than the side walls 104*a*, 104*b*, 104*c*, and 104*d*. The tray 100 is positioned underneath the condenser apparatus in order to conserve space and is located such that the float containing compartment 106 underlies the auxiliary outlet opening 78 so that liquid passing through the outlet opening 78 will fall or be dispensed initially into the float containing compartment. The float containing compartment is dimensioned so that liquid being introduced into that compartment will cause the float mechanism 112 to respond quickly. In other words, a relatively small amount of liquid in the compartment 106 will cause the float 114 of the float mechanism to be raised quickly and correspondingly pivot the float lever arm 116 about pivot pin 117 which in turn by suitable coupling causes an electrical switch 118 to be actuated. Other liquid level sensing means may be used to respond to the liquid level in the compartment 106 and in turn cause the switch 118 to be actuated.

The electrical arrangement of the condenser apparatus is connected in circuit with the switch 118 such that when it is actuated the condenser apparatus is de-energized. That is, the electric current to the motor 86 and to the solenoid that operates the water inlet valve is turned off by actuation of the switch. This is accomplished by any suitable electrical switching arrangement easily designed by an electrician to accommodate the system in which the condenser apparatus is used. It should be appreciated that it is highly desirable to have the apparatus de-energized as quickly as possible once liquid has overflowed from the auxiliary liquid outlet 78. There is, however, a time lag in the de-energization process and after the float mechanism 112 actuates the switch there still is liquid flow from the auxiliary outlet 78 into the float containing compartment 106. By my de-energization apparatus I provide a liquid reserve compartment 108 separated from the float containing compartment 106 by a partition 110. As pointed out above, this partition has a height less than the side walls 104*a*, 104*b*, 104*c*, and 104*d*, however, it should be of a height sufficient to retain liquid in the float containing compartment until the float is raised sufficiently to de-energize the condenser apparatus. Subsequent to the de-energizing operation liquid may pass over the partition 110 and into the reserve compartment 108. Reserve compartment 108 should have a capacity sufficient to accommodate liquid overflow from the condenser apparatus after the de-energization process. In this manner then liquid is retained in a tray and isolated from the electrical components of the condenser apparatus and any other components of the appliance in which it may be incorporated. It should be noted that this tray configuration minimizes the amount of space taken up by such an apparatus de-energization means which is quite important when the condenser apparatus is incorporated in an appliance such as a clothes dryer as space is very important, particularly when the cabinet size is required to be no larger than a standard clothes dryer.

At the rear of the condenser housing 10 is a rear wall 80 which forms part of the condenser housing. The rear wall 80 together with cylindrical wall section 82 of housing 10 and inwardly directed circular flange 84 form the blower chamber 32. Secured to the rear wall 80 on the opposite side from the blower chamber 32 is an electric motor 86 which may be suitably attached to the rear wall as by bolts 88. The electric motor has a rotatable shaft 40 extending through an aperture in the rear wall 80 close to the central longitudinal axis of the condenser apparatus. Secured to this motor shaft 40, which extends into the condenser housing, are the four rotatable elements of the condenser apparatus, namely, the blower 24, the liquid droplet interceptor wheel 34, inner wall 50 of the pump 48, and the disc 22. The single motor 86 rotatably drives all four of these condenser apparatus elements.

The operation of the condenser and dryer apparatus is as follows: Hot moisture-laden air, such as perhaps air that has been passed through a clothes dryer drum and picked up moisture from the fabrics tumbled therein, is introduced into the condenser unit through the air inlet opening 12 while a stream of cooling liquid is being introduced into the condenser unit through tubular conduit 16 controlled by a solenoid operated liquid inlet valve (not shown). When the condenser apparatus is operating the electric motor provides for simultaneous rotation of the blower 24, liquid droplet interceptor wheel 34, inner wall 50 of pump 48 and disc 22. As disc 22 is being rotated a stream of liquid being introduced impinges upon the disc and forms liquid droplets. The generally radial flight of the liquid droplets is interrupted by the inner surface 94 of the condenser housing 10 whereupon the liquid droplets are deflected back toward the center of the condenser chamber 68; this in effect produces a curtain or cloud of liquid droplets within the condensing chamber 48 while the incoming hot moisture-laden air flows through this resultant liquid droplet cloud.

The hot moisture-laden air in contact with the cooler liquid droplets causes the air temperature to be lowered and the moisture condensed therefrom. Because the air flowing through the condenser chamber 68 may entrain some liquid droplets the water droplet collecting means 34 is positioned upstream of the blower 24 between the disc 22 and blower 24 so that entrained liquid droplets are essentially collected by the rotating blades 36 and deposited in an underlying liquid bath 96 which is in communication with the pump reservoir through an opening 66. It will be understood that simultaneously with the introduction of cooling liquid into the condenser apparatus through the tubular conduit 16 liquid will also be removed from the condenser apparatus by the pump 48 at a rate such that only a small amount of liquid is in the liquid bath 96 at a given time during operation of the condenser apparatus.

The liquid is removed from the condenser apparatus by utilizing the pump 48 described heretofore. The rotating inner pump wall 50 is driven by the electric motor and the revolutions per minute should be such that the ring of liquid captured in the pump cavity 62 is rotated relative to the stationary wall 56 sufficiently to effect pumping of the liquid out of the outlet 64.

The air that has been cooled passes through the interceptor wheel 34 and pump 48 and into the blower 24 which applies air pressure to induce the air flow and force the air out of the condenser apparatus through air outlet 26.

Should the condenser apparatus malfunction such that the pump cannot pump the liquid out of the apparatus at a rate to prevent overflow then the auxiliary liquid outlet 78 will provide a means for the overflow liquid to be discharged from the condenser apparatus. The overflow liquid will flow or fall into the float containing compartment 106 of the underlying tray 100. As the liquid level within the compartment 106 rises so does float 114 which causes float lever arm 116 to be pivoted and actuate the switch 118 which in turn de-energizes the condenser apparatus as described heretofore. After de-energization of the condenser apparatus any further liquid flowing into that float containing compartment 106 will pass over the partition 110 and into the reserve compartment 108. In this manner the liquid will be retained in the tray 100 until a service repair call can be made to determine the reason for the malfunction of the condenser apparatus.

The foregoing is a description of the preferred embodiment of the invention and variations may be made thereto without departing from the spirit of the invention, as defined in the appended claims.

What is claimed is:

1. Condenser apparatus for removing moisture from air by passing moisture-laden air through a cloud of cooling liquid droplets having:

a. a housing,
b. liquid inlet means at one end of said housing,
c. air inlet means at said one end of the housing,
d. air outlet means at the end of the housing opposite the air inlet means,
e. a condensing chamber between the air inlet and outlet, f. means to form a liquid droplet cloud within the condensing chamber, g. means for inducing air to flow from the air inlet means through the condensing chamber to the air outlet means, h. means for collecting liquid droplets which is positioned within the housing and located between the means to form a liquid droplet cloud and the air flow inducing means, i. a pump for removing liquid from the condenser apparatus, j. means for driving the rotatable components including the pump, and k. an auxiliary liquid discharge outlet having an opening outside the condensing chamber, the improvement comprising apparatus deenergization means having a tray with sidewalls and two compartments, the first compartment underlying the auxiliary discharge outlet and having a liquid level sensing means connected in cooperative relationship to a switch for de-energizing the apparatus and the other compartment being separated from the first by a partition of a height sufficient to retain liquid until the liquid level sensing means de-energizes the apparatus and lower than the side walls of the tray.

2. The condenser apparatus of claim 1 wherein the liquid level sensing means is a float mechanism located within the said first compartment.

3. The condenser apparatus of claim 1 wherein the auxiliary liquid discharge outlet includes a sump in communication with the outlet opening, the sump being partially located within the condensing chamber at the bottom thereof.

4. In an automatic clothes dryer machine having a cabinet, a drum mounted for rotation within the cabinet to tumble clothes to be dried, means for passing air through the drum and heating means to heat the air, and a condenser apparatus through which the air passes to be cooled and remove moisture, the condenser apparatus having:

a. a housing, b. liquid inlet means at one end of said housing, c. air inlet means at said one end of the housing, d. air outlet means at the end of the housing opposite the air inlet means, e. a condensing chamber between the air inlet and outlet, f. means to form a liquid droplet cloud within the condensing chamber, g. means for inducing air to flow from the air inlet means through the condensing chamber to the air outlet means, h. means for collecting liquid droplets which is positioned within the housing and located between the means to form a liquid droplet cloud and the air flow inducing means, i. a pump for removing liquid from the condenser apparatus, j. means for driving the rotatable components including the pump, and k. an auxiliary liquid discharge outlet having an opening outside the condensing chamber, the improvement comprising apparatus deenergization means having a tray with sidewalls and two compartments, the first compartment underlying the auxiliary discharge outlet and has a liquid level sensing means connected in cooperative relationship to a switch for de-energizing the apparatus and the other compartment being separated from the first one by a partition of a height sufficient to retain liquid until the liquid level sensing means de-energizes the apparatus and lower than the side walls of the tray.

5. The condenser apparatus of claim 4 wherein the liquid level sensing means is a float mechanism located within the said first compartment.

6. The condenser apparatus of claim 4 wherein the auxiliary liquid discharge outlet includes a sump in communication with the outlet opening, the sump being partially located within the condensing chamber at the bottom thereof.

* * * * *